United States Patent [19]

Watanabe et al.

[11] Patent Number: 4,941,234

[45] Date of Patent: Jul. 17, 1990

[54] BUTTON COLLET

[75] Inventors: Hirokazu Watanabe, Kurobe; Yoshihiro Kanzaka, Toyama, both of Japan

[73] Assignee: Yoshida Kogyo K. K., Tokyo, Japan

[21] Appl. No.: 409,938

[22] Filed: Sep. 20, 1989

[30] Foreign Application Priority Data

Sep. 22, 1988 [JP] Japan ..... 63-124122[U]

[51] Int. Cl.[5] ..... A44B 1/00

[52] U.S. Cl. ..... 24/113 MP; 24/90 A

[58] Field of Search ..... 24/113 R, 113 MP, 90 A, 24/90 R, 90 HA, 304, DIG. 11, 94–96

[56] References Cited

U.S. PATENT DOCUMENTS

| | | | |
|---|---|---|---|
| 1,577,079 | 3/1926 | Ross et al. | 24/95 |
| 2,723,433 | 11/1955 | Van Buren, Jr. | 24/90 R |
| 2,823,479 | 2/1958 | Zdanowski | 24/113 MP X |
| 3,448,495 | 6/1969 | Chernack et al. . | |
| 3,583,039 | 6/1971 | Walker . | |

FOREIGN PATENT DOCUMENTS

| | | |
|---|---|---|
| 1936163 | 1/1971 | Fed. Rep. of Germany . |
| 1114093 | 12/1955 | France . |
| 58-131707 | 9/1983 | Japan . |
| 61-109316 | 7/1986 | Japan . |
| 61-131907 | 8/1986 | Japan . |

*Primary Examiner*—James R. Brittain

*Attorney, Agent, or Firm*—Hill, Van Santen, Steadman & Simpson

[57] ABSTRACT

A button collet is disclosed for use with a mating tack to form a button on a garment fabric. The collet includes a cap having a dove-tail cavity, an insert member adhesively bonded in place therein, and a shank member or eyelet fixedly secured to the insert member. The insert member has a plurality of clamping lugs which are crimped around a flanged peripheral edge of the shank and a plurality of peripheral notches in spaced apart relation alternating with the clamping lugs.

12 Claims, 10 Drawing Sheets

BUTTON COLLET

BACKGROUND OF THE INVENTION

1. Field of the Invention

This invention relates to a button collet for use with a mating tack to be mounted on a garment fabric, and has particular reference to such a button collet to which a support shank is adhesively secured.

2. Prior Art

A variety of buttons have been proposed in the art which typically comprise a button collet to be joined together with a tack member across a garment fabric to form a button thereon. The button collet includes a cap or head having either a flat or a domed outer surface on which any suitable indicia is often carried to serve as an ornamental decoration. A shank member or an eyelet is fixedly secured at one end to the button collet with use of an adhesive compound and has the opposite end disposed for engagement through the fabric with a male or female coupling member usually in the form of a tack.

A prior art example of a button collet of the type which includes such a shank member adhesively secured in place is disclosed in Japanese Utility Model Laid-Open Publication No. 58-131707 in which the shank member is bonded in place by an adhesive deposited in a dove-tail groove formed in the button surface of a collet cap.

Another example is disclosed in Japanese Utility Model Laid-Open Publication No. 61-131907 in which a button collet has a cap convexly domed to provide a relatively large cavity in which a shank member is adhesively secured, any excess adhesive or glue being disposed in the cavity.

A problem arises with the above prior art button devices in that if separation of the adhesive compound occurs, the shank member or eyelet being smaller in diameter than the groove or cavity would become disengaged from the cap of the collet, or become rotative relative to the cap resulting in improperly oriented indicia on the cap, or else any excess of the adhesive compound would ooze out to make the whole button quite unsightly.

SUMMARY OF THE INVENTION

With the foregoing drawbacks of the prior art in view, the present invention seeks to provide an improved button collet incorporating structural features whereby the shank member can be retained in place with the cap, and the cap can be prevented from becoming rotative in the event of separation of the adhesive compound from the inner surface of the cap.

A button collet according to the invention which comprises a cap having a dove-tail cavity, an insert member adhesively bonded by an adhesive compound in place in said cavity and having a plurality of clamping lugs extending radially inward from its lower peripheral edge and a shank member having a peripheral flange fixedly secured to said clamping lugs, said insert member including a plurality of peripheral notches alternating with said clamping lugs.

The above object and other features of the invention will be better understood from the following detailed description taken in conjunction with the accompanying drawings. Like reference numerals refer to like or corresponding structural parts throughout the several views.

DETAILED DESCRIPTION

Figure 1:
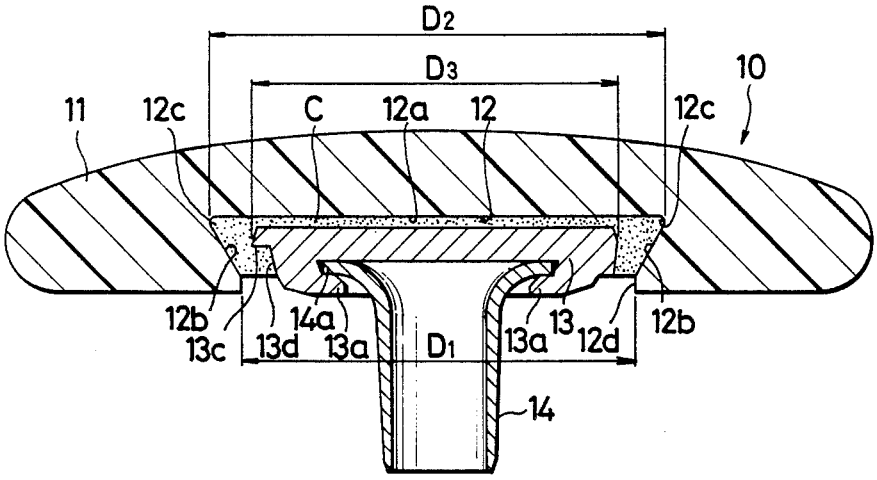
FIG. 1 is a cross-sectional view on enlarged scale of a button collet embodying the invention.

Referring now to the drawings and FIG. 1 in particular, there is shown a button collet 10 according to a preferred embodiment of the invention which is adapted to be joined together with a mating tack (not shown) to form a button on a compliant material such as a garment fabric (not shown). The button collet 10 comprises a generally dome-shaped cap 11 having a cavity 12 concentric therewith, an insert member 13 adhesively bonded in place in the cavity 12, and a shank member or eyelet 14 fixedly secured to the insert member 13.

The domed cap 11 is formed from a plastics or metallic material which may be transparent or opaque. The cavity 12 formed generally like a dove-tail groove as shown in FIG. 1–8, is defined by a substantially flat annular bottom wall **12*a* and a peripheral side wall 12*b* which is directed inwardly from a marginal edge 12*c* of the bottom wall 12*a* to terminate at an outer peripheral edge 12*d*, providing a dovetail cross-sectional configuration as shown in FIG. 1. The diameter $D_1$ of the cavity 12 as measured across the outer peripheral edge 12*d* is smaller than the diameter $D_2$ as measured across the marginal edge 12*c***.

Figure 2:
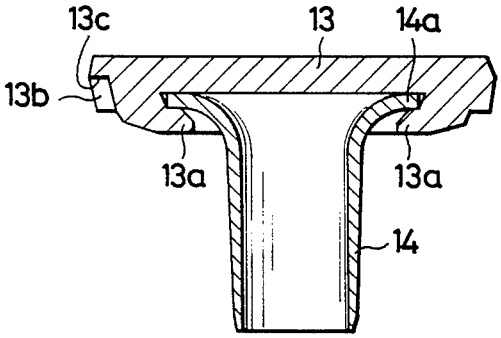
FIG. 2 is a view similar to FIG. 1 but exclusively showing a shank member and an insert member associated therewith.

The insert member 13 is generally in the form of a disc plate having a plurality of clamping lugs **13*a* extending radially inward from its lower peripheral edge and adapted to fasten the shank member 14 to the insert member 13. To this end, the shank member 14 has its upper end portion flared to form a peripheral flange 14*a* over which the clamping lugs 13*a* of the insert 13 are turned in or crimped to envelop the flange 14*a* thereby securely affixing the shank 14 to the insert 13** as shown in FIGS. 1 and 2. The diameter $D_3$ of the insert member 13 is slightly smaller than the diameter $D_1$ of the cavity 12. Thus, the relations of the three diameters are $D_3<D_1<D_2$. This applies also to the embodiment shown in FIG. 9.

Figure 3:
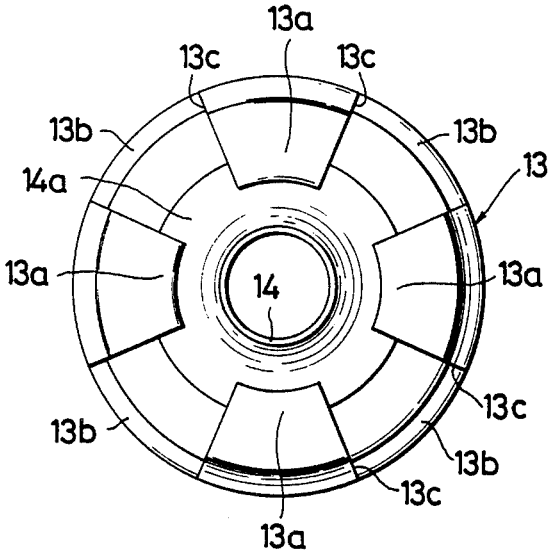
FIG. 3 is a bottom end view of FIG. 2.

As better shown in FIG. 3, the insert member 13 has a plurality of peripheral notches 13*b* alternating with adjacent clamping lug 13*a* and each defined by end walls 13*c*.

When joining the insert member 13 carrying the shank 14 with the cap 11, this is done by the use of a suitable adhesive such as an epoxy resin compound C which is applied conveniently to the bottom wall 12*a* of the cap 11. The upper surface of the insert member 13 is inserted in the cavity 12 with its upper surface abutting against the adhesive compound C deposited on the bottom wall 12*a* of the cap 11. As the insert member 13 is forced against the cap 11, the adhesive compound C spreads over with excess of it moving toward the peripheral side wall 12*b* and filling the notches 13*b*. As the compound C becomes hardened in this manner with part of it embedded in the notches 13*b*, the insert member 13 is firmly bonded in place with respect to the cap 11. If the adhesive compound layer C should for some reason separate from the cap 11, that portion of the compound which is embedded in each of the notches 13*b* would still retain the insert member 13 in place against separation from the cap 11 per se. Furthermore, the notches 13*b* being alternate in position with the lugs 13*a* would also prevent the tendency of the insert member 13 to rotate relative to the cap 11.

Figure 4:
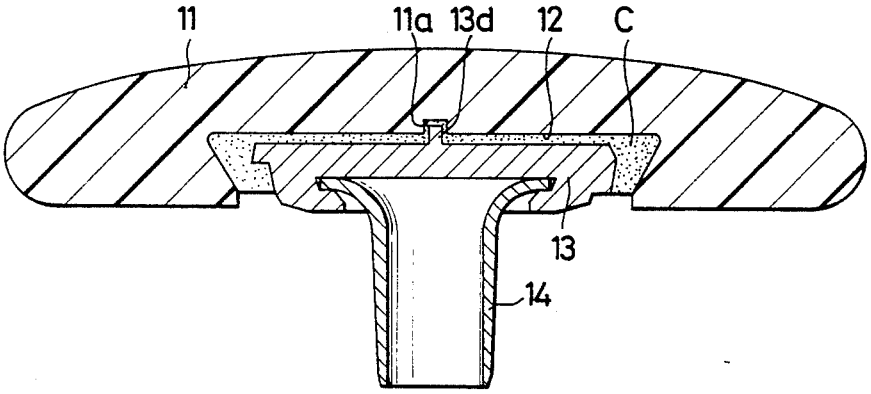
FIG. 4 is a cross-sectional view of a modified form of button collet according to the invention.

FIG. 4 shows a modification of button collet according to the invention which is identical with the collet of FIG. 1 except that there are provided an anchoring plug member 13*d* extending upwardly centrally from the insert member 13 and a complimentary socket member 11*a* formed centrally in the bottom wall 12*a* of the cap 11 and adapted to receive the plug member 13*d*. This plug and socket arrangement ensures centering of the insert member 13 or shank 14 with respect to the cap 11.

Figure 5:
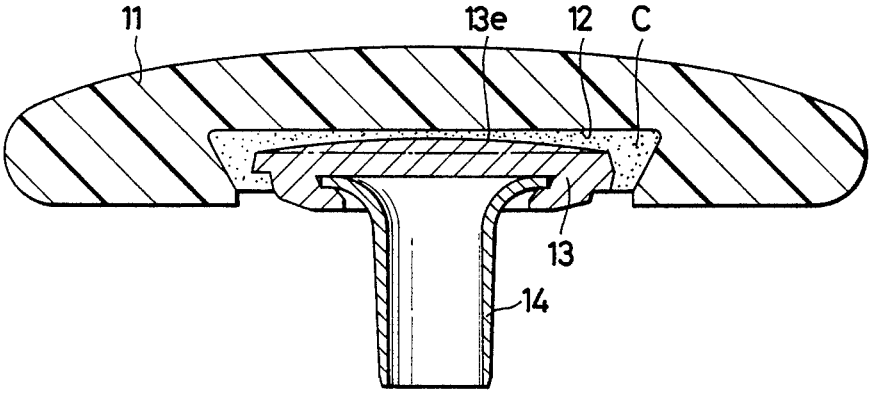
FIG. 5 is a cross-sectional view of another modified form according to the invention.

Another modification is shown in FIG. 5 which is characterized by the provision of an insert member 13 having a convex upper surface 13*e* whereby air or air bubbles in the adhesive compound C can be forced to disperse toward the peripheral areas of the cavity 12 and dismissed from view through the cap 11 should the latter be transparent.

Figure 6A:
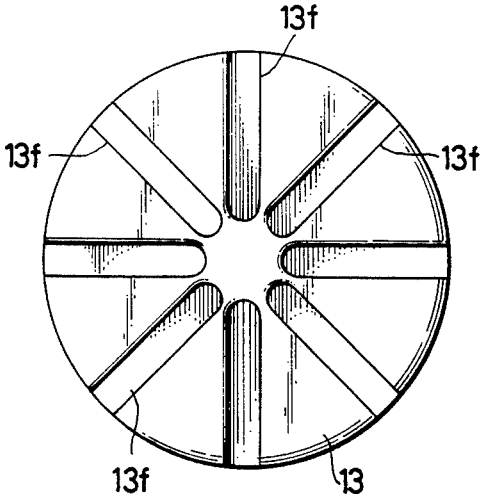
FIGS. 6A–6D inclusive are plan views of different forms of the insert member.
Figure 6B:
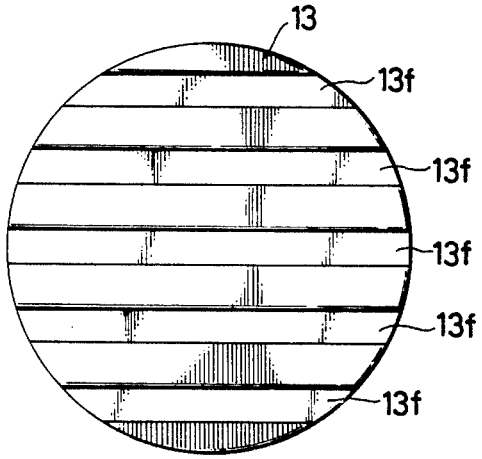
Figure 6C:
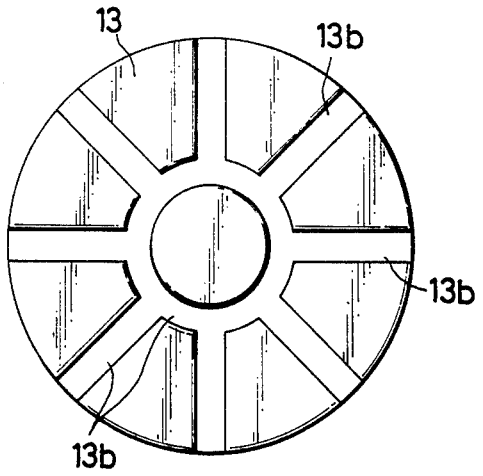
Figure 6D:
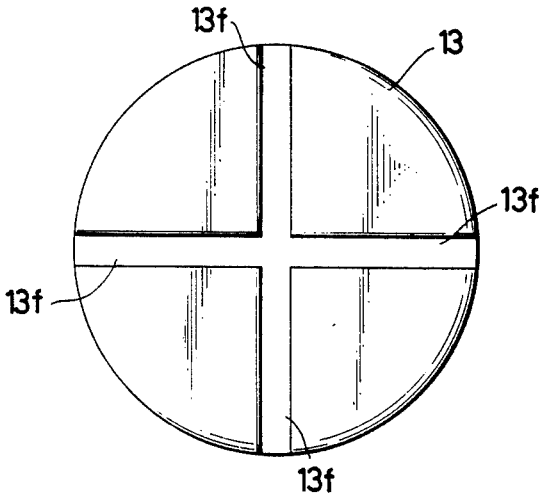

FIGS. 6A–6D inclusive show different insert members 13 each having different forms of groove 13*f* in their convex upper surfaces, the arrangement being intended to expel air bubbles from sight at once and provide increased surface area, hence increased bonding strength of the adhesive. FIG. 6A shows a plurality of radially extending grooves 13*f*; FIG. 6B a plurality of parallel grooves 13*f*; FIG. 6C a combination of radial and annular grooves 13*f*; and FIG. 6D a criss-cross groove 13*f*.

Figure 7:
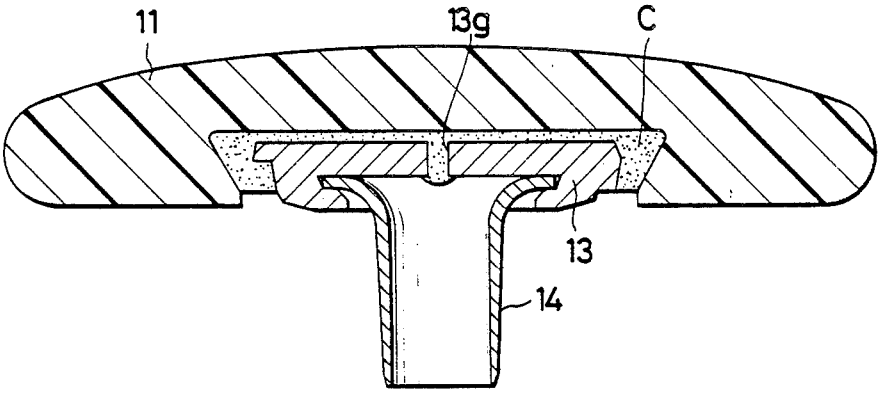
FIG. 7 is a cross-sectional view of a further modified form of button collet according to the invention.

A modification shown in FIG. 7 is similar to the collet of FIG. 1 except that there is formed centrally in the insert member 13 a vertically extending through aperture (or apertures) 13*g* which serves the three fold purposes; viz., to provide escape of air bubbles, increased bond strength and accommodation of excess adhesive C which would otherwise ooze out to present unsightly appearance of the button.

Figure 8:
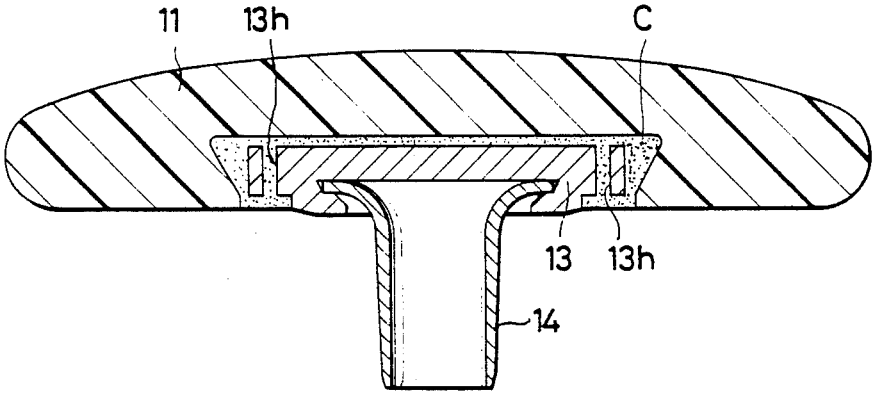
FIG. 8 is a cross-sectional view of still another modified form of button collet according to the invention.

A modification in FIG. 8 is characterized by the provision of a plurality of through apertures 13*h* spaced apart around the periphery of the insert member 13 whereby the bond strength of the adhesive compound is increased manifold.

Figure 9:
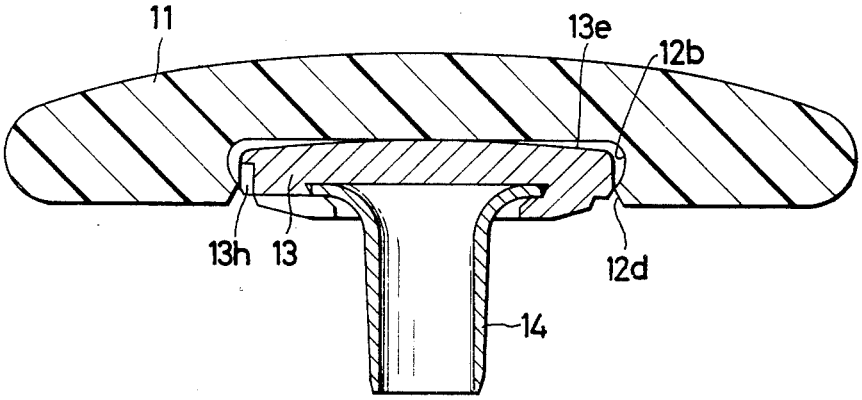
FIG. 9 is a cross-sectional view of still further modification of the inventive collet.
Figure 10:
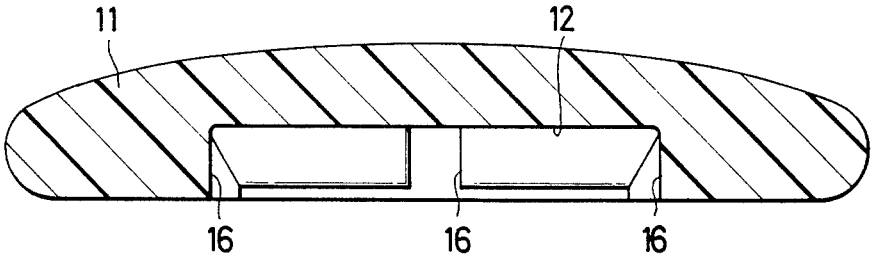
FIG. 10 is a cross-sectional view of a modified form of cap member.
Figure 11:
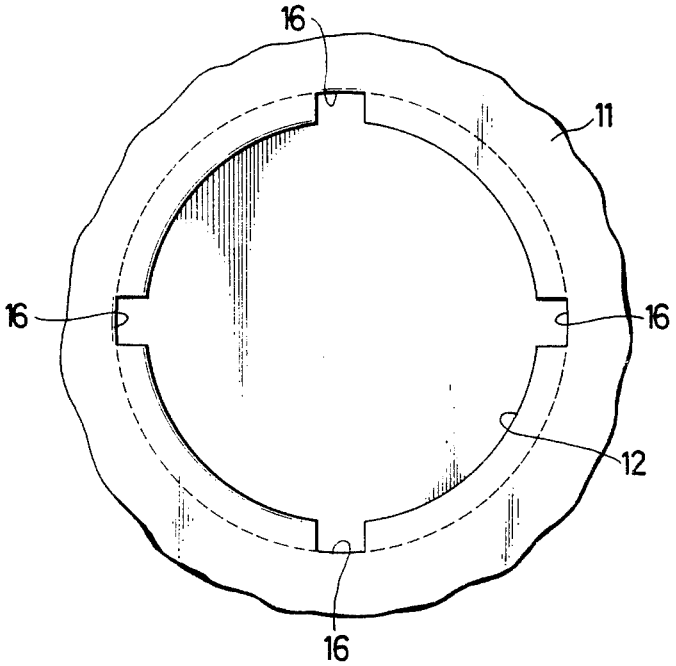
FIG. 11 is a bottom end view of a portion of the cap of FIG. 10.
Figure 12:
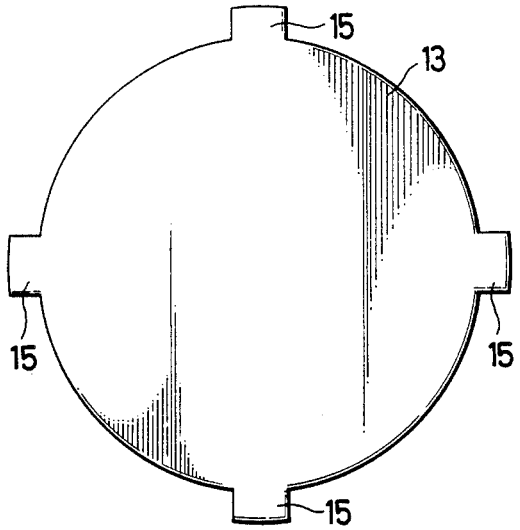
FIG. 12 is a plan view of a modified form of insert member.

FIG. 9 shows a slightly different modification having a peripheral side wall 12*b* which is cross-sectionally somewhat arcuate and an outer peripheral edge 12*d* which is somewhat outwardly flared. This modification also features an insert member 13 having part of its upper surface 13*e* slightly convexed to provide benefits similar to the embodiment of FIG. 5.

Figure 13:
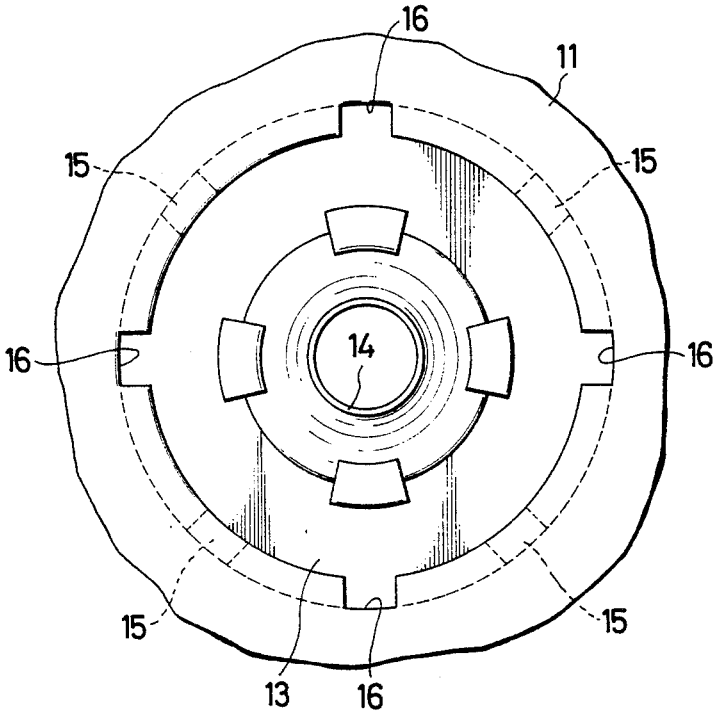
FIG. 13 is a bottom end view of the cap of FIG. 10 shown assembled with the insert of FIG. 12.

A further modification is illustrated in FIGS. 10 through 13 inclusive, which is devised to further enhance attachment of the insert member 13 with the cap 11. The insert member 13 as more clearly shown in FIG. 12 has a plurality of clamping lugs 15 projecting radially outward in a criss-cross fashion. The cap member 11 as better shown in FIG. 11 has a corresponding number of peripheral recesses 16 for receiving the clamping lugs 15 on the insert member 13. The cap 11 and the insert 13 are connected in locking relation to each other by first registering the lugs 15 with the recesses 16 and are bonded together by the adhesive C in the cavity 12 after they are slightly rotated as indicated by dotted line away from the original positions indicated by solid line as shown in FIG. 13.

Figure 14:
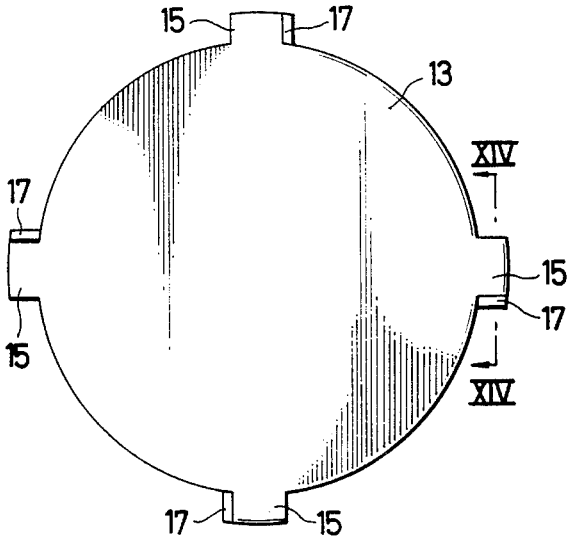
FIG. 14 is a plan view of a further modified form of insert member.
Figure 15:
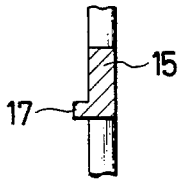
FIG. 15 is a cross-sectional view taken on the line XIV—XIV of FIG. 14.

FIGS. 14 and 15 show another modification which is similar to the embodiment of FIGS. 10–13 except that the clamping lugs 15 each have a lateral protuberance 17 adapted to restrict excessive rotation of the insert member 13 when coupled with the cap 11.

Obviously, various modifications and variations of the present invention are possible in the light of the above teaching. It is therefore to be understood that within the scope of the appended claims the invention may be practiced otherwise than as specifically described.

What is claimed is:

1. A button collet which comprises a cap having a cavity concentric therewith, an insert member adhesively bonded by an adhesive compound in place in said cavity and having a plurality of clamping lugs extending radially inward from its lower peripheral edge and a shank member having a peripheral flange fixedly secured to said clamping lugs, said insert member including a plurality of peripheral notches alternating with said clamping lugs.

2. A button collet according to claim 1 further including an anchoring plug member extending upwardly centrally from said insert member and a complimentary socket member formed centrally in a bottom wall of said cap and adopted to receive said plug member.

3. A button collet according to claim 1 wherein said insert member has at least in part a convex upper surface.

4. A button collet according to claim 3 wherein said insert member has a plurality of grooves in its upper surface.

5. A button collet according to claim 4 wherein said grooves extend radially inward.

6. A button collet according to claim 4 wherein said grooves extend in parallel with each other.

7. A button collet according to claim 4 wherein said grooves are in the form of a combination of radial and annular grooves.

8. A button collet according to claim 4 wherein said grooves are in the form of a cross.

9. A button collet according to claim 1 further including a through aperture extending vertically centrally through said insert member.

10. A button collet according to claim 1 further including a plurality of through apertures spaced apart around the periphery of said insert member.

11. A button collet according to claim 1 wherein said insert member has a plurality clamping lugs projecting radially outward in a criss-cross fashion and said cap has a corresponding number of peripheral recesses for receiving said radially outwardly projecting lugs.

12. A button collet according to claim 11 wherein said insert member has a protuberance laterally projecting from each of said radially outwardly projection lugs.

* * * * *